US009140014B2

(12) United States Patent
Castel

(10) Patent No.: US 9,140,014 B2
(45) Date of Patent: Sep. 22, 2015

(54) COVERING DEVICE HAVING SLIDING COVER ELEMENTS

(71) Applicant: Jean-Louis Castel, Poitiers (FR)

(72) Inventor: Jean-Louis Castel, Poitiers (FR)

( * ) Notice: Subject to any disclaimer, the term of this patent is extended or adjusted under 35 U.S.C. 154(b) by 0 days.

(21) Appl. No.: 14/380,141

(22) PCT Filed: Feb. 22, 2013

(86) PCT No.: PCT/FR2013/050365
§ 371 (c)(1),
(2) Date: Aug. 21, 2014

(87) PCT Pub. No.: WO2013/124594
PCT Pub. Date: Aug. 29, 2013

(65) Prior Publication Data

US 2015/0013238 A1 Jan. 15, 2015

(30) Foreign Application Priority Data

Feb. 24, 2012 (FR) ..... 12 51707

(51) Int. Cl.

| | |
|---|---|
| ***E04B 1/346*** | (2006.01) |
| ***E04F 10/10*** | (2006.01) |
| ***E04B 7/16*** | (2006.01) |
| ***E04B 1/19*** | (2006.01) |
| ***E04B 1/343*** | (2006.01) |
| ***E04D 13/04*** | (2006.01) |

(52) U.S. Cl.
CPC . *E04F 10/10* (2013.01); *E04B 1/19* (2013.01); *E04B 1/34305* (2013.01); *E04B 7/166* (2013.01); *E04D 13/0445* (2013.01); *E04B 2001/1993* (2013.01)

(58) Field of Classification Search
CPC ..... A01G 9/241; E04F 10/10
USPC ..... 52/67, 64, 66
See application file for complete search history.

(56) References Cited

U.S. PATENT DOCUMENTS

| | | | | |
|---|---|---|---|---|
| 2,094,801 | A * | 10/1937 | Mass | 52/64 |
| 4,674,241 | A * | 6/1987 | Sarrazin | 52/67 |
| 5,778,603 | A * | 7/1998 | Reppas | 52/66 |
| 8,413,705 | B2 | 4/2013 | Castel | |
| 2003/0014927 | A1 * | 1/2003 | Brooks | 52/66 |

(Continued)

FOREIGN PATENT DOCUMENTS

| | | |
|---|---|---|
| AT | 7 687 U2 | 7/2005 |
| DE | 20 2010 015864 | 2/2011 |

(Continued)

OTHER PUBLICATIONS

International Search Report dated Jun. 13, 2013, corresponding to PCT/FR2013/050365.

*Primary Examiner* — Basil Katcheves
(74) *Attorney, Agent, or Firm* — Young & Thompson

(57) ABSTRACT

A covering device (10) forming a protective surface (12) of variable length (L12) and/or width (W12), includes: a support frame (14) of predefined length (L14) and width (W14), at least two intermediate frames (I1, I2 etc.) supported by the support frame (14), each intermediate frame (I1, I2 etc.) supporting at least two cover elements (E1, E2, E3, E4, E5, E6 etc.) mounted so as to be able to slide one under the other, the covering device (10) being characterized in that the intermediate frames (I1, I2 etc.) are mounted on the support frame (14) so as to be able to slide one under the other equally in one or the other of two opposing sliding directions ((C1, C2)(C3, C4)) taken in the length (L14) or width (W14) of the support frame.

14 Claims, 4 Drawing Sheets

(56) References Cited

U.S. PATENT DOCUMENTS

| | | | | |
|---|---|---|---|---|
| 2006/0248807 | A1* | 11/2006 | Penna | 52/64 |
| 2007/0051054 | A1* | 3/2007 | Devincenzo et al. | 52/72 |
| 2011/0162808 | A1 | 7/2011 | Castel | |

FOREIGN PATENT DOCUMENTS

| | | |
|---|---|---|
| EP | 1 029 445 | 8/2000 |
| FR | 2935723 | 3/2010 |
| WO | 2011/067545 | 6/2011 |

* cited by examiner

COVERING DEVICE HAVING SLIDING COVER ELEMENTS

BACKGROUND OF THE INVENTION

1. Field of the Invention

This invention relates to a device for covering an outside surface, such as a patio.

More particularly, however, the invention relates to a covering device making it possible to ensure variable protection according to the weather conditions.

Actually, it is significant to be able to adapt the protection based on the angle of the sun or to retract the covering device when the rain has stopped.

2. Description of the Related Art

A first device of the prior art that is commonly used for performing these functions takes the shape of an external awning comprising a cover element that can be rolled up around a roll-up shaft.

Once unrolled, the cover element can be located in a horizontal plane or in a plane that is slightly inclined relative to the horizontal.

This external awning is generally attached along the external façade of the building or the house in front of which the external surface to be covered is located, with the roll-up shaft being held by supports connected to the external façade.

To change the covered surface, the cover element is unrolled or rolled up by electrical drive means or more simply using a crank handle.

According to a first drawback of the devices of the external awning type, the cover element can be retracted only in the direction of the roll-up shaft or within the width of the surface to be covered.

Consequently, it is not possible to cover a distant zone within the width of the external surface without covering the closest zone of the façade and the roll-up shaft of the cover element.

According to another drawback, these devices of the external awning type do not make it possible to adapt the length of the covering element.

Therefore, it is not possible to uncover completely a first part taken within the length of the external surface while keeping the other part covered.

A second device of the prior art making it possible to adapt the protection to the external conditions is described in the French Patent FR-2,935,723.

The covering device described in this document FR-2,935,723 comprises movable flaps that are mounted to rotate around their axes and that are longitudinal and connected in parallel to a carrying frame.

So as to form a cover varying between a closed, airtight, and translucent configuration and an opaque configuration while passing through open and partially opaque configurations, each flap comprises a section made of translucent material extending along a longitudinal axis around which said flap is mounted to rotate and at least one strip made of opaque material mounted to rotate relative to said flap along a longitudinal axis that is parallel to the longitudinal axis of the section.

Although making it possible to better adapt the protection to sunshine conditions by an intermittent arrangement, this second device of the prior art has almost the same drawbacks as the first device of the prior art.

Actually, it also has a protective surface that cannot be modified in terms of length or width.

Consequently, it offers neither the possibility of uncovering completely a zone taken in the width of the covered external surface nor the possibility of uncovering completely a part taken in the length of the external surface to be covered.

In addition, the manufacturing and primarily the mounting of the movable strips in the flaps considerably increase the production costs of this second device, which should nevertheless be sold at competitive prices relative to other outside equipment for adding to a house or a building.

Finally, the documents AT-007,687, EP-1,029,445 and DE-20.2010.015864 describe covering devices in which cover elements taking the shape of panels are mounted to slide in intermediate frames that are juxtaposed but stationary relative to their support frame.

Consequently, and because of the stationary mounting of the intermediate frames, the covering devices described in these documents of the prior art do not make it possible to uncover the external covered surface as much as possible. The purpose of this invention is to remedy the drawbacks of the prior art.

BRIEF SUMMARY OF THE INVENTION

For this purpose, the invention has as its object a covering device forming a protective surface with variable length and/or width, with the covering device comprising cover elements forming the protective surface and arranged in such a way as to change the width and/or the length of the protective surface by one sliding relative to another, the covering device also comprising:

- A support frame with predefined length and width,
- At least two intermediate frames with predefined length and width and supported by the support frame,
- Each intermediate frame supporting at least two cover elements that are mounted in such a way as to be able to slide under one another equally in one or the other of the two opposing sliding directions taken in the length or in the width of this intermediate frame.

According to the invention, the covering device is characterized in that the intermediate frames are mounted on the support frame in such a way as to be able to slide under one another equally in one or the other of the two opposing sliding directions taken in the length or in the width of the support frame.

Owing to the sliding mounting of the intermediate frames, the covering device according to the invention makes it possible to reduce as much as possible the width and the length of the protective surface.

BRIEF DESCRIPTION OF THE DRAWINGS

Other characteristics and advantages will emerge from the following description of the invention, a description that is provided by way of example only, relative to the accompanying drawings in which.

DETAILED DESCRIPTION OF THE PREFERRED EMBODIMENTS

Figure 1:
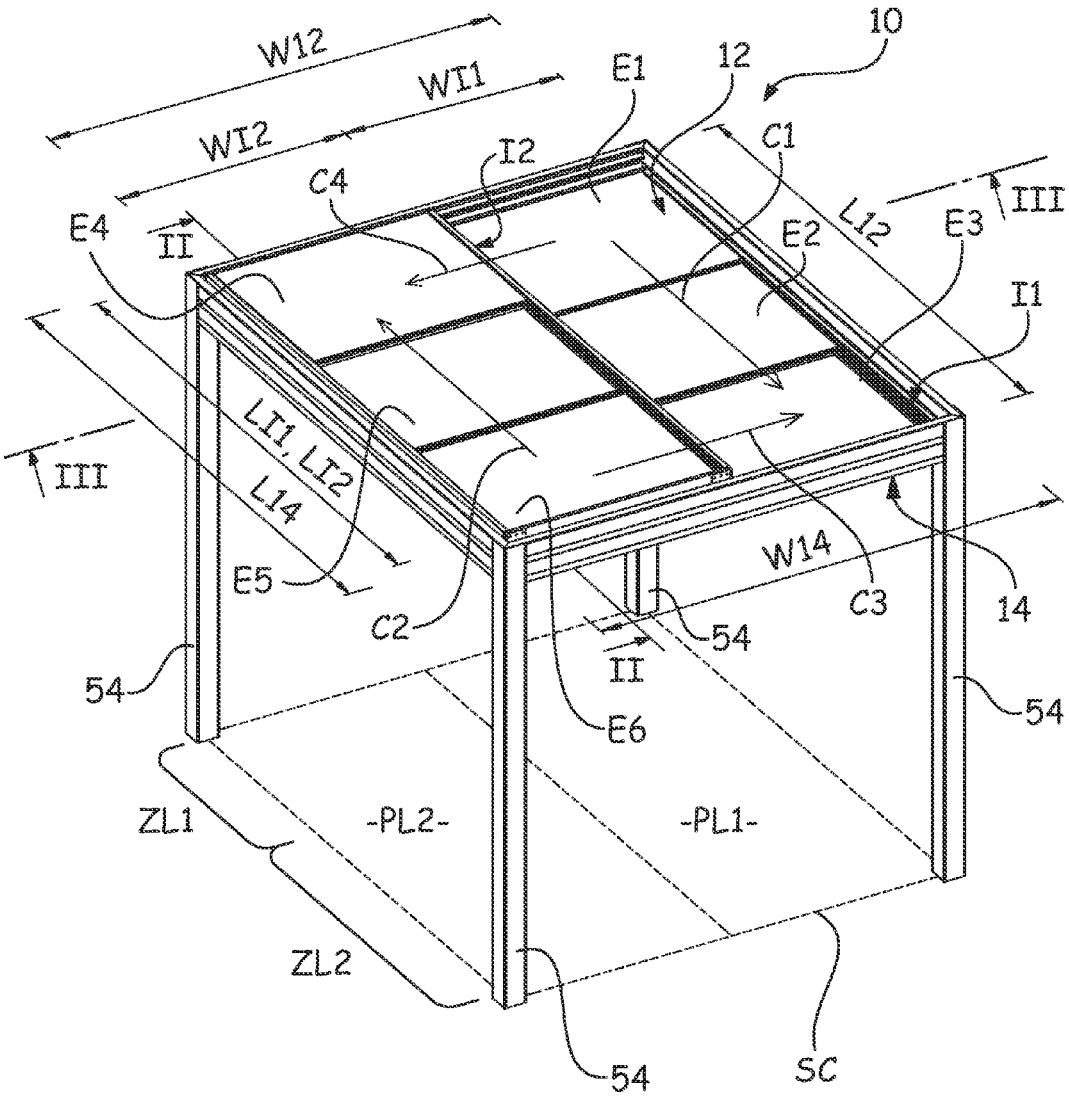
FIG. 1 shows a perspective view of a first embodiment of a covering device according to the invention.

As illustrated in FIG. 1, this invention relates to a covering device 10 forming a protective surface 12 with variable length L12 and/or width W12.

For this purpose, the covering device 10 comprises cover elements (E1, E2, E3, E4, E5, E6, . . . ) forming the protective surface 12 and arranged in such a way as to change the width W12 and/or the length L12 of the protective surface by one sliding relative to another.

As illustrated by four arrows in FIG. 1, the covering device 10 comprises at least two cover elements (E1, E2, E3, E4, E5, E6, . . . ) sliding under one another equally in one or the other of two opposing sliding directions ((C1, C2)(C3, C4)) taken in the length L12 and/or in the width W12 of the protective surface 12.

In more detail, the covering device 10 according to the invention comprises:

A support frame 14 with predefined length L14 and width W14,

At least two intermediate frames (I1, I2, . . . ) with a length (LI1, LI2) and width (WI1, WI2) that are predefined and supported by the support frame 14, Each intermediate frame (I1, I2, . . . ) supporting at least two cover elements (E1, E2, E3, E4, E5, E6 . . . ) mounted in such a way as to be able to slide under one another equally in one or the other of two opposing sliding directions ((C1, C2)(C3, C4)) taken in the length (LI1, LI2) or in the width (WI1, WI2) of this intermediate frame.

Advantageously, owing to the sliding of the cover elements, the covering device according to the invention makes it possible, for example, to uncover completely one or the other of two lateral zones (ZL1, ZL2) with a surface to be covered SC.

So as to form a continuous protective surface 12 at each intermediate frame, the cover elements ((E1, E2, E3), (E4, E5, E6), . . . ) of each intermediate frame (I1, I2, . . . ) cover the entire surface defined by the width (WI1, WI2) and by the length (LI1, LI2) of this intermediate frame when they are separated relative to one another in the opposing sliding directions ((C1, C2)(C3, C4)) and put edge to edge in the length (LI1, LI2) or in the width (WI1, WI2) of this intermediate frame.

So as to reduce as much as possible the protective surface 12 when the cover elements ((E1, E2, E3), (E4, E5, E6), . . . ) of each intermediate frame (I1, I2, . . . ) are superposed below one another, the intermediate frames (I1, I2, . . . ) can also be mounted on the support frame 14 in such a way as to be able to slide under one another equally in one or the other of two opposing sliding directions ((C1, C2)(C3, C4)) taken in the length L14 or in the width W14 of the support frame.

Advantageously, owing to the sliding of the intermediate frames, the covering device according to the invention makes it possible, for example, to uncover completely one or the other of two longitudinal parts (PL1, PL2) of the surface to be covered SC.

So as to form a maximum and continuous protective surface 12 at the support frame, the cover elements ((E1, E2, E3), (E4, E5, E6), . . . ) cover the entire surface defined by the width W14 and by the length L14 of the support frame 14 when the intermediate frames (I1, I2, . . . ) are separated relative to one another in the opposing sliding directions ((C1, C2)(C3, C4)) and put edge to edge in the length L14 or in the width W14 of the support frame, and when the cover elements ((E1, E2, E3), (E4, E5, E6), . . . ) are separated relative to one another in the opposing sliding directions ((C1, C2)(C3, C4)) and put edge to edge in the length (LI1, LI2) or in the width (WI1, WI2) of the intermediate frames.

Figure 2:
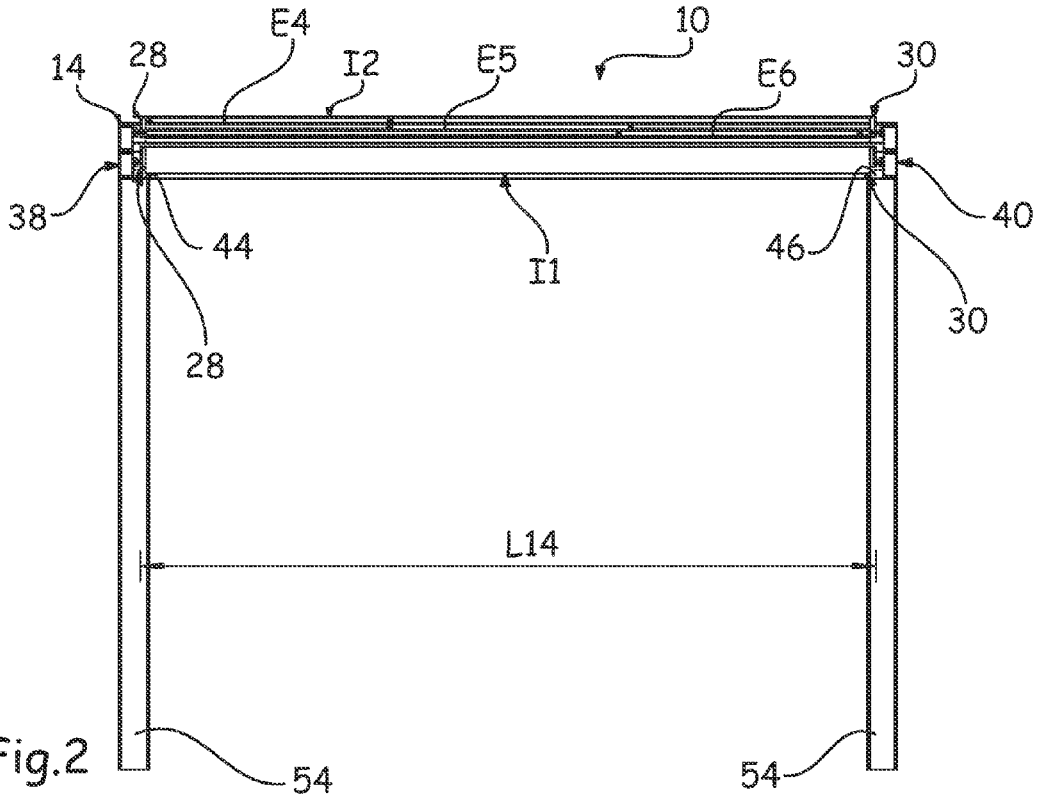
FIG. 2 shows a longitudinal cutaway view of a first embodiment of a covering device according to the invention.
Figure 3:
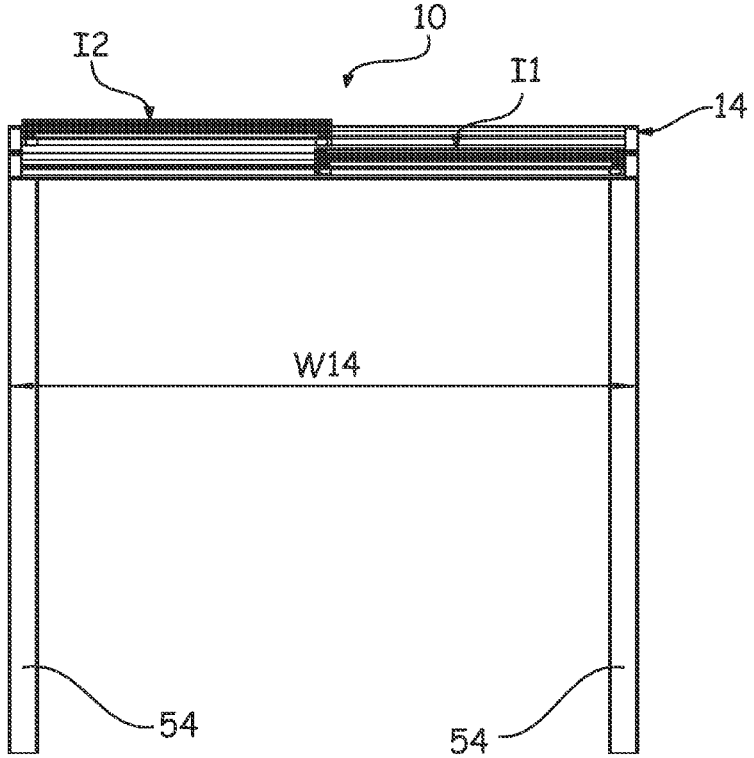
FIG. 3 shows a transverse cutaway view of a first embodiment of a covering device according to the invention.

In a first embodiment illustrated by the longitudinal and transverse cutaway views of FIGS. 2 and 3, the support frame 14 supports two intermediate frames (I1, I2) each supporting three cover elements ((E1, E2, E3), (E4, E5, E6)).

Figure 5:
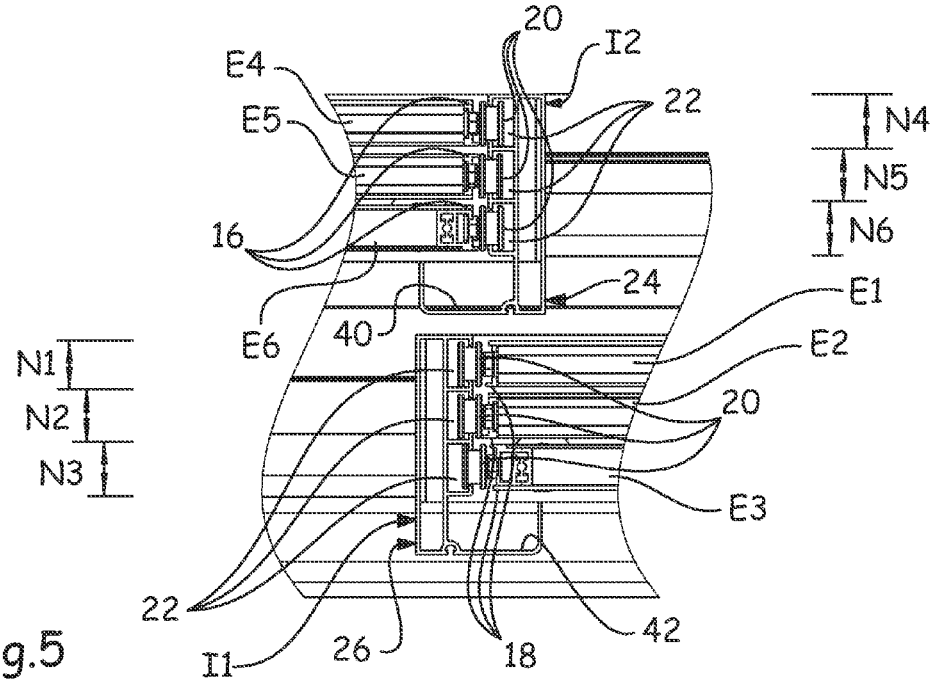
FIG. 5 is a detail view of FIG. 3.

As illustrated by the detail view of FIG. 5, the cover elements ((E1, E2, E3), (E4, E5, E6)) are mounted to slide in the length (LI1, LI2) of the intermediate frames (I1, I2) over three levels ((N1, N2, N3), (N4, N5, N6)) that are different and superposed in height.

Figure 4:
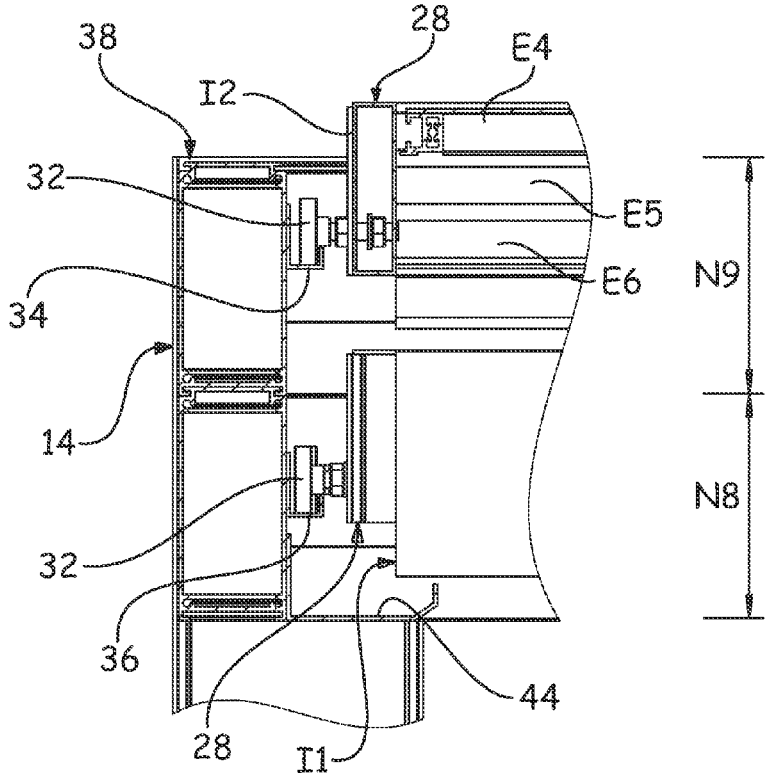
FIG. 4 is a detail view of FIG. 2.

Also, as illustrated by the detail view of FIG. 4, the intermediate frames (I1, I2) are mounted to slide in the width W14 of the support frame 14 on two levels (N8, N9) that are different and superposed in height.

Figure 6:
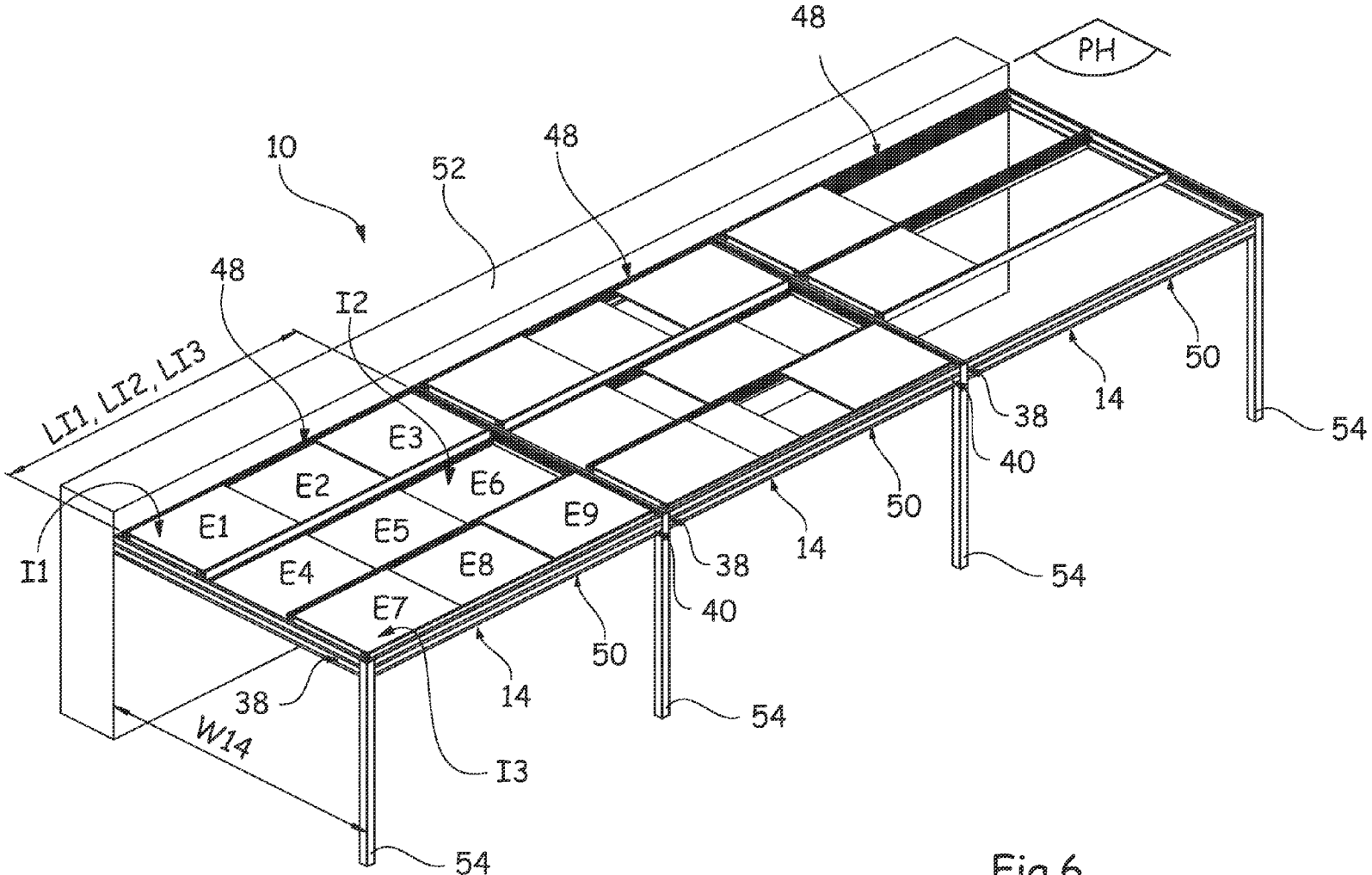
FIG. 6 shows a perspective view of a second embodiment of a covering device according to the invention.

In a second embodiment illustrated by the perspective view in FIG. 6, the support frame 14 supports three intermediate frames (I1, I2, I3) each supporting three cover elements ((E1, E2, E3), (E4, E5, E6), (E7, E8, E9)), with the cover elements ((E1, E2, E3), (E4, E5, E6), (E7, E8, E9)) being mounted to slide in the length (LI1, LI2, LI3) of the intermediate frames (I1, I2, I3) over three levels that are different and superposed in height, and the intermediate frames (I1, I2, I3) being mounted to slide in the width W14 of the support frame 14 over two levels that are different and superposed in height, with two intermediate frames (I1, I3) being located on the same level.

This second embodiment proposes an arrangement whose purpose is to refine the profile of the support frame 14 of the covering device 10.

Of course, the invention also covers other embodiments that can be arranged in a similar way to preceding modes with more or fewer intermediate cover elements and frames.

For the implementation of the sliding mounting in the different embodiments of the invention, the longitudinal edges (16, 18) of the cover elements (E1, E2, E3, E4, E5, E6, E7, E8, E9, . . . ) are equipped with rollers 20 accommodated in slides 22 provided along the longitudinal struts (24, 26) of each intermediate frame (I1, I2, I3, . . . ), and the lateral struts (28, 30) of the intermediate frames (I1, I2, I3, . . . ) are equipped with rollers 32 accommodated in slides (34, 36) provided along lateral supports (38, 40) of the support frame 14.

Still in the different embodiments of the invention, so as to form a protective surface 12 that is essentially airtight when the intermediate frames and the cover elements are deployed edge to edge, the cover elements (E1, E2, E3, E4, E5, E6, E7, E8, E9, . . . ) are solid and designed in such a way as to direct rainwater toward grooves (40, 42) provided along longitudinal struts (24, 26) of each intermediate frame (I1, I2, I3, . . . ), and the intermediate frames (I1, I2, I3, . . . ) are designed in such a way as to direct rainwater toward channels (44, 46) provided along lateral supports (38, 40) of the support frame 14.

In addition, the longitudinal edges (16, 18) of the cover elements (E1, E2, E3, E4, E5, E6, E7, E8, E9, . . . ) and the lateral struts (28, 30) of the intermediate frames (I1, I2, I3, . . . ) through which the rainwater is directed can comprise a lower anti-drip profile.

According to different variant embodiments, the cover elements (E1, E2, E3, E4, E5, E6, E7, E8, E9, . . . ) can be manufactured from a material that is more or less opaque, more or less transparent, or more or less translucent.

In another more enhanced variant, the cover elements (E1, E2, E3, E4, E5, E6, E7, E8, E9, . . . ) can also consist of movable sun-shield elements.

For better flexural strength, the cover elements (E1, E2, E3, E4, E5, E6, E7, E8, E9, . . . ) can have a slightly curved profile, preferably upward to prevent the accumulation of rainwater.

The cover elements (E1, E2, E3, E4, E5, E6, E7, E8, E9, . . . ) of the covering device 10 according to the invention are quadrilateral, as well as intermediate frames (I1, I2, I3, . . . ) and the support frame (14).

Preferably, the cover elements (E1, E2, E3, E4, E5, E6, E7, E8, E9, . . . ), the intermediate frames (I1, I2, I3, . . . ) and the support frame (14) are square or rectangular, but an implementation of these elements in the form of parallelograms can also be provided.

In the different embodiments of the invention, the cover elements (E1, E2, E3, E4, E5, E6, E7, E8, E9, . . . ) can comprise disengageable means for braking, or even stopping, their translational movement relative to their respective intermediate frame (I1, I2, I3, . . . ) and/or the intermediate frames (I1, I2, I3, . . . ) can comprise disengageable means for braking, or even stopping, their translational movement relative to the support frame 14.

Advantageously, these braking/stopping means can be actuated/disengaged by means of a control provided below the cover element or the intermediate frame.

Also, and instead of a manual drive, it may be provided to motorize and to control remotely the sliding of the cover elements (E1, E2, E3, E4, E5, E6, E7, E8, E9, . . . ), with different means known to one skilled in the art making it possible to carry out these improvements.

As illustrated in FIG. 6, the covering device 10 according to the invention can also comprise an arrangement of several support frames 14 each with their respective intermediate frames (I1, I2, I3, . . . ) and their own cover elements (E1, E2, E3, E4, E5, E6, E7, E8, E9, . . . ).

According to a first variant of an arrangement of several support frames 14, the support frames 14 can be coupled to one another along their lateral supports (38, 40).

According to a second variant of an arrangement of several support frames 14, the support frames 14 can be coupled to one another along their longitudinal supports (48, 50).

According to a third variant of an arrangement of several support frames 14, the support frames 14 can also be mounted offset in height relative to one another and optionally one sliding relative to another.

In a general manner and for the purpose of forming a large protective surface 12, it may be provided to combine as many support frames 14 as necessary, each with as many respective intermediate frames (I1, I2, I3, . . . ) and cover elements (E1, E2, E3, E4, E5, E6, E7, E8, E9, . . . ) as necessary.

In the same objective for formation of a large protective surface 12, it may be provided to combine covering devices 10 within another covering device 10, and this as many times as necessary, with covering devices 10 constituting the cover elements of a larger covering device.

In the implementation of the covering device 10 according to the invention, the support frame(s) 14 can be arranged in an essentially horizontal plane PH or in an essentially inclined plane relative to the horizontal, connected using adapted supports against a wall or a façade 52, as illustrated in FIG. 6, and/or held at a desired height above the surface to be covered using posts 54, as illustrated in FIGS. 1 and 6.

The invention claimed is:

1. A covering device forming a protective surface with a variable length and/or width, the covering device comprising:

a plurality of cover elements forming the protective surface and configured to change the width and/or the length of the protective surface by one sliding relative to another, a support frame with a predefined length and width; and at least two intermediate frames with a predefined length and width and supported by the support frame, each intermediate frame supporting at least two cover elements that are mounted to be able to slide under one another equally in one or the other of two opposing sliding directions taken in the length or in the width of the intermediate frame, the intermediate frames being mounted on the support frame to be able to slide under one another equally in one or the other of two opposing sliding directions taken in the length or in the width of the support frame.

2. The covering device according to claim 1, wherein at least two of the cover elements slide under one another equally in one or the other of two opposing sliding directions taken in the length and/or in the width of the protective surface.

3. The covering device according to claim 1, wherein the cover elements of each intermediate frame cover the entire surface defined by the width and by the length the intermediate frame when the cover elements are separated relative to one another in the opposing sliding directions and put edge-to-edge in the length or in the width of the intermediate frame.

4. The covering device according to claim 1, wherein the cover elements cover the entire surface defined by the width and by the length of the support frame when the intermediate frames are separated relative to one another in the opposing sliding directions and put edge-to-edge in the length or in the width of the support frame, and when the cover elements are separated relative to one another according to the opposing sliding directions and put edge-to-edge in the length or in the width of the intermediate frames.

5. The covering device according to claim 1, wherein the support frame supports two intermediate frames, each intermediate frame supporting three of the cover elements, with the three cover elements being mounted to slide in the length of the intermediate frames on three levels that are different and superposed in height, and the intermediate frames are mounted to slide in the width of the support frame on two levels that are different and superposed in height.

6. The covering device according to claim 1, wherein the support frame supports three intermediate frames, each intermediate frame supporting three cover elements, the three cover elements being mounted to slide in the length of intermediate frames on three levels that are different and superposed in height, the intermediate frames being mounted to slide in the width of the support frame on two levels that are different and superposed in height, two intermediate frames being located on the same level.

7. The covering device according to claim 1, wherein the longitudinal edges of the cover elements include rollers accommodated in slides provided along longitudinal struts of each intermediate frame, and lateral struts of the intermediate frames include rollers accommodated in slides provided along the lateral supports of the support frame.

8. The covering device according to claim 1, wherein the cover elements are solid and configured to direct rainwater toward grooves provided along longitudinal struts of each intermediate frame, and the intermediate frames are configured to direct rainwater toward channels provided along lateral supports of the support frame.

9. The covering device according to claim 8, wherein the longitudinal edges of the cover elements and the lateral struts of the intermediate frames through which the rainwater is directed comprise a lower anti-drip profile.

10. The covering device according to claim 1, wherein the cover elements comprise disengageable means for braking, or stopping, their translational movement relative to their respective intermediate frame and/or the intermediate frames comprise disengageable means for braking, or stopping, their translational movement relative to the support frame.

11. The covering device according to claim 1, wherein the cover elements are manufactured from an opaque, transparent, or translucent material, or consist of movable sun-shield elements.

12. The covering device according to claim 1, wherein the cover elements have a slightly curved profile.

13. The covering device according to claim 1, wherein the cover elements, the intermediate frames, and the support frame are quadrilateral.

14. The covering device according to claim 1, further comprising an arrangement of several support frames, each support frame having a respective one of the intermediate frames and a respective one of the cover elements.

* * * * *